US007874651B2

(12) United States Patent
Suzuki

(10) Patent No.: US 7,874,651 B2
(45) Date of Patent: Jan. 25, 2011

(54) LIQUID DROPLET DISCHARGE HEAD AND LIQUID DROPLET DISCHARGE APPARATUS

(75) Inventor: Shigeru Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 142 days.

(21) Appl. No.: 12/395,690

(22) Filed: Mar. 1, 2009

(65) Prior Publication Data

US 2009/0219346 A1 Sep. 3, 2009

(30) Foreign Application Priority Data

Feb. 29, 2008 (JP) ..... 2008-049054

(51) Int. Cl.
*B41J 2/045* (2006.01)
*B41J 2/05* (2006.01)

(52) U.S. Cl. ..... 347/68; 347/58

(58) Field of Classification Search ..... 347/68, 347/69–72, 57, 58, 59; 400/124.14, 124.16; 310/311, 324, 327

See application file for complete search history.

(56) References Cited

U.S. PATENT DOCUMENTS 6,913,349 B2 * 7/2005 Hirota ..... 347/72
7,008,048 B2 3/2006 Sakaida
7,290,865 B2 11/2007 Hibi et al.
7,370,943 B2 * 5/2008 Imai et al. ..... 347/58
7,517,065 B2 * 4/2009 Isono ..... 347/71
2004/0160494 A1 8/2004 Isono et al.

FOREIGN PATENT DOCUMENTS

JP 2003-311954 A 11/2003
JP 2005-059551 A 3/2005

* cited by examiner

*Primary Examiner*—K. Feggins
(74) *Attorney, Agent, or Firm*—Baker Botts L.L.P.

(57) ABSTRACT

A piezoelectric actuator includes upper and lower constant electric potential electrodes. The upper constant electric potential electrodes are connected to a first-common conducting section extending in a predetermined direction, both ends of the first-common conducting section are connected to second-common conducting sections, and thus a first electrode assembly is formed. Both ends of the lower constant electric potential electrodes extending in the predetermined direction are connected to third-common conducting sections, and thus a second electrode assembly is constructed. A flexible wiring board stacked on the piezoelectric actuator has a first-connecting land extending in the predetermined direction and to which one of the first and second electrode assemblies having a smaller voltage drop when a predetermined current is applied is connected, and second-connecting lands to which the other is connected and which are arranged on both end sides of the first-connecting land.

19 Claims, 12 Drawing Sheets

LIQUID DROPLET DISCHARGE HEAD AND LIQUID DROPLET DISCHARGE APPARATUS

CROSS REFERENCE TO RELATED APPLICATION

The present application claims priority from Japanese Patent Application No. 2008-049054, filed on Feb. 29, 2008, the disclosure of which is incorporated herein by reference in its entirety.

BACKGROUND OF THE INVENTION

1. Field of the Invention

The present invention relates to a liquid droplet discharge head and a liquid droplet discharge apparatus provided with the same.

2. Description of the Related Art

An ink-jet printer has been hitherto known as one of the liquid droplet discharge apparatus, including an ink-jet head (liquid droplet discharge head) provided with a flow passage unit which has a plurality of pressure chambers formed regularly, a piezoelectric actuator which is joined to the flow passage and which is provided to selectively discharge the ink contained in each of the pressure chambers, and a voltage-applying mechanism which applies the voltage to the piezoelectric actuator. In order to realize the high image quality and the high quality of the recording by increasing the number of nozzles in the ink-jet head as described above, it is required to highly density the pressure chambers. When the pressure chambers are arranged at a high density, the distance between the adjoining pressure chambers is shortened. Therefore, the influence, i.e., the so-called crosstalk is caused, which is exerted on the adjoining pressure chamber when the piezoelectric actuator is driven.

U.S. Pat. Nos. 7,008,048 and 7,290,865 (corresponding to Japanese Patent Application Laid-open No. 2003-311954) suggest structures to suppress the crosstalk. An ink-jet head described in U.S. Pat. Nos. 7,008,048 and 7,290,865 include individual electrodes having main electrode sections 35*a* which are formed on a piezoelectric sheet 41 separated farthest from the pressure chambers 10 in an actuator unit 21. Grooves 61*a*, 61*b*, which are "L-shaped", are formed on the both sides of the main electrode section 35*a* corresponding to areas disposed between the main electrode section 35*a* and the main electrode sections 35*a* of the adjoining individual electrodes. According to this structure, the grooves 61*a*, 61*b* are formed in the areas corresponding to the areas disposed between the adjoining pressure chambers 10 in the actuator unit 21. Therefore, it is possible to suppress the crosstalk in which the deformation of the active layer, which is brought about by the piezoelectric effect, affects the adjoining pressure chamber.

According to the ink-jet head described in U.S. Pat. Nos. 7,008,048 and 7,290,865, the amount of deformation, which is transmitted to the active layer of the adjoining pressure chamber when the active layer corresponding to a certain pressure chamber is deformed, is decreased owing to the formation of the grooves 61*a*, 61*b* as compared with a case in which the grooves 61*a*, 61*b* are not formed. However, it is requested to realize a higher image quality, and it is also demanded to provide a higher density in relation to the arrangement of the pressure chambers. Therefore, any countermeasure against the crosstalk, which is more excellent than the above, has been requested. In view of the above, the present inventors have invented a structure of an actuator as described later on. However, in order to stabilize the operation of the actuator in such a structure, a problem exists in relation to the wiring.

SUMMARY OF THE INVENTION

The present invention described below relates to a wiring structure for applying the driving voltage to a piezoelectric actuator in a liquid droplet discharge head.

According to a first aspect of the present invention, there is provided a liquid droplet discharge head, including: a flow passage unit which has a plurality of pressure chambers and discharge holes communicated with the pressure chambers respectively, the pressure chambers forming a plurality of pressure chamber rows each of which extends in a first direction and the pressure chamber rows being arranged in a second direction perpendicular to the first direction; a piezoelectric actuator which is stacked on the flow passage unit and which includes a first piezoelectric layer; a plurality of individual electrodes formed on one surface of the first piezoelectric layer and arranged to form arrays each extending in the first direction corresponding to the pressure chambers respectively; a first electrode assembly formed on the other surface of the first piezoelectric layer and including upper constant electric potential electrodes which are formed and arranged to form arrays corresponding to the individual electrodes respectively, first-common conducting sections to which the arrays of the upper constant electric potential electrodes are connected respectively and each of which extends in the first direction, and two second-common conducting sections which extend in the second direction and to which each of the first-common conducting sections is connected at both ends thereof; a second piezoelectric layer arranged on a side of the other surface of the first piezoelectric layer to interpose the first electrode assembly between the first piezoelectric layer and the second piezoelectric layer; and a second electrode assembly formed on a surface, of the second piezoelectric layer, not facing the first piezoelectric layer and including lower constant electric potential electrodes which are arranged to form arrays corresponding to the arrays of the individual electrodes to extend in the first direction, and two third-common conducting sections to which both ends of each of the lower constant electric potential electrodes are connected respectively and each of which extends in the second direction; and a wiring board which is stacked on the piezoelectric actuator and which includes individual electrode connecting sections applying an electric potential to the individual electrodes; and a constant electric potential electrode connecting section applying an electric potential to the upper constant electric potential electrodes and the lower constant electric potential electrodes, the constant electric potential electrode connecting section including a first-connecting land extending in the first direction and two second-connecting lands arranged on both sides of the first-connecting land in the first direction, wherein the second-connecting lands are arranged in the first direction nearer, than the first-connecting land, to the second-common conducting sections and the third-common conducting sections respectively; one of the first electrode assembly and the second electrode assembly of the piezoelectric actuator, which has a greater voltage drop due to internal resistance existing therein when a predetermined current is applied thereto, is electrically connected to the second-connecting lands and the other of the first and second electrode assemblies, which has a smaller voltage drop, is electrically connected to the first-connecting land.

According to the first aspect of the present invention, the liquid droplet discharge head is constructed such that the advantage is given to the electrode assembly which is included in the first electrode assembly and the second electrode assembly and which has the greater impedance. Accordingly, it is possible to stabilize the operation of the piezoelectric layer of the piezoelectric actuator.

The liquid droplet discharge head of the present invention may further include first relay electrodes which are connected to both ends of the two second-common conducting sections respectively and which are arranged at four corners of the piezoelectric actuator; and a second relay electrode which is connected, at both ends thereof, to the two third-common conducting sections respectively and which extends in the first direction, and the first relay electrodes may be electrically connected to the second-connecting lands respectively, and the second relay electrode may be electrically connected to the first-connecting land. In this case, the first relay electrodes may be arranged at positions at which the first relay electrodes are overlapped with the second-connecting lands in a stacking direction respectively when the wiring board is stacked on the piezoelectric actuator.

The liquid droplet discharge head of the present invention may further include a first relay electrode which is connected to the upper constant electric potential electrodes and which is arranged at a subsequently central portion of the piezoelectric actuator in the first direction; and a second relay electrode which has both ends connected to the two third-common conducting sections respectively and which extends in the first direction, and the first relay electrode may be electrically connected to the first-connecting land, and the second relay electrode may be electrically connected to the second-connecting lands. In this case, the second relay electrode may be arranged at a position at which the second relay electrode is overlapped with the second-connecting lands in a stacking direction when the wiring board is stacked on the piezoelectric actuator.

In the liquid droplet discharge head of the present invention, the constant electric potential electrode connecting section of the wiring board may be provided on the wiring board along one end edge portion in the second direction or the constant electric potential electrode connecting section of the wiring board may be provided on the wiring board at each of both end edge portions in the second direction.

In the liquid droplet discharge head of the present invention, a through-hole, via which the constant electric potential electrode connecting section of the wiring board and the first electrode assembly or the second electrode assembly are electrically connected, may be formed at a portion, of the piezoelectric actuator, located at a position overlapped with the constant electric potential electrode connecting section of the wiring board in a stacking direction.

In the liquid droplet discharge head of the present invention, the wiring board may further be provided with driver ICs which are disposed on the wiring board at both ends in the first direction and which are electrically connected to the individual electrodes to supply driving signals.

According to a second aspect of the present invention, there is provided a liquid droplet discharge head, including: a flow passage unit which has a plurality of pressure chambers and discharge holes communicated with the pressure chambers respectively, the pressure chambers forming a plurality of pressure chamber rows each of which extends in a first direction and the pressure chamber rows being arranged in a second direction perpendicular to the first direction; a piezoelectric actuator which is stacked on the flow passage unit and which includes a first piezoelectric layer; a plurality of individual electrodes formed on one surface of the first piezoelectric layer and arranged to form arrays each extending in the first direction, corresponding to the pressure chambers respectively; a first electrode assembly formed on the other surface of the first piezoelectric layer and including upper constant electric potential electrodes which are formed and arranged to form arrays corresponding to the individual electrodes respectively, first-common conducting sections to which the arrays of the upper constant electric potential electrodes are connected respectively and each of which extends in the first direction, and two second-common conducting sections which extend in the second direction and to which each of the first-common conducting sections is connected at both ends thereof; a second piezoelectric layer arranged on a side of the other surface of the first piezoelectric layer to interpose the first electrode assembly between the first piezoelectric layer and the second piezoelectric layer; and a second electrode assembly formed on a surface, of the second piezoelectric layer, not facing the first piezoelectric layer and including lower constant electric potential electrodes which are formed and arranged to form arrays, corresponding to arrays of the individual electrodes, to extend in the first direction, and two third-common conducting sections to which each of the lower constant electric potential electrodes is connected at both ends thereof and each of which extends in the second direction; and a wiring board which is stacked on the piezoelectric actuator and which includes individual electrode connecting sections applying an electric potential to the individual electrodes; and a constant electric potential electrode connecting section applying an electric potential to the upper constant electric potential electrodes and the lower constant electric potential electrodes; the constant electric potential electrode connecting section including: a first-connecting land which is arranged on the wiring board on one end side in the second direction and which extends in the first direction; and two second-connecting lands which are arranged on both sides of the first-connecting land in the first direction, and the second-connecting lands are arranged in the first direction nearer, than the first-connecting land, to the second-common conducting sections and the third-common conducting sections; and one of the second-common conducting sections of the first electrode assembly and the third-common conduction sections of the second electric assembly has a greater electric potential difference generated at one end on the one end side in the second direction, during a time period during which the piezoelectric actuator is driven; and the first electrode assembly is electrically connected to the second-connecting lands and the second electrode assembly is electrically connected to the first-connecting land when the second common conducting sections has the greater electric potential difference; and the second electrode assembly is electrically connected to the second-connecting lands and the first electrode assembly is electrically connected to the first-connecting land when the third common conducting sections has the greater electric potential difference.

According to the second aspect of the present invention, the liquid droplet discharge head is constructed such that the difference between the electric potential to be applied substantially uniformly to the entire constant electric potential electrodes and the electric potential actually applied to the constant electric potential electrodes is more decreased. Accordingly, it is possible to stabilize the operation of the piezoelectric layer of the piezoelectric actuator.

According to a third aspect of the present invention, there is provided a liquid droplet discharge apparatus, including the liquid droplet discharge head as defined in the first or second aspect.

DESCRIPTION OF THE PREFERRED EMBODIMENTS

Figure 1:
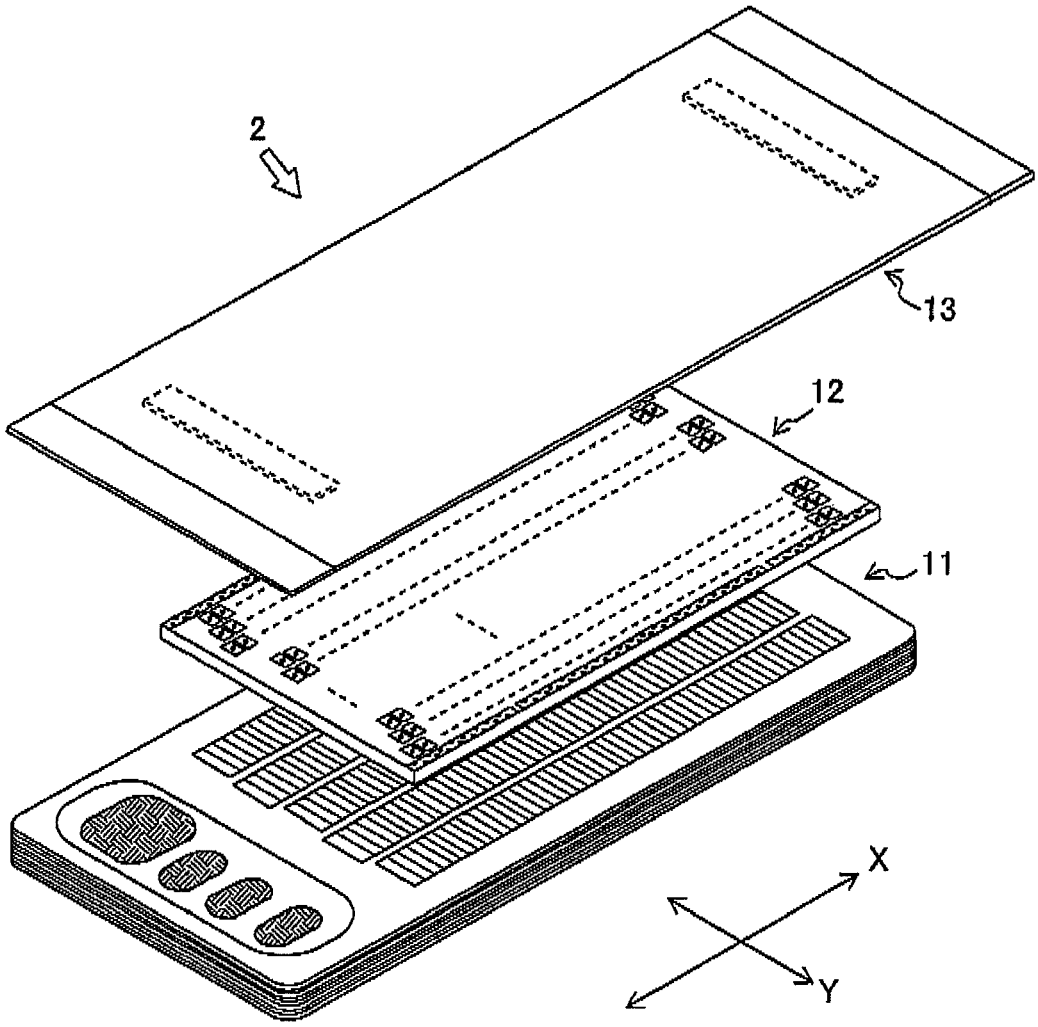
FIG. 1 shows an exploded perspective view illustrating an arrangement of a liquid droplet discharge head.

A preferred embodiment of the present invention will be explained below with reference to the drawings. In the following description, identical or equivalent components or parts are designated by the same reference numerals throughout all of the drawings, any duplicate explanation of which will be omitted.

Figure 2:
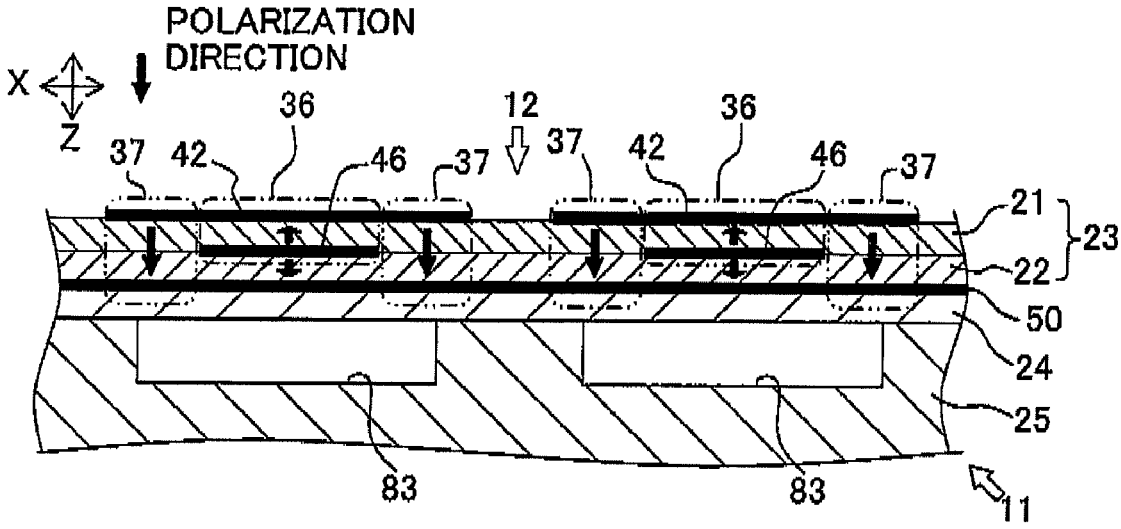
FIG. 2 shows a partial sectional view in a predetermined direction illustrating an arrangement of a piezoelectric actuator and a flow passage unit.
Figure 3:
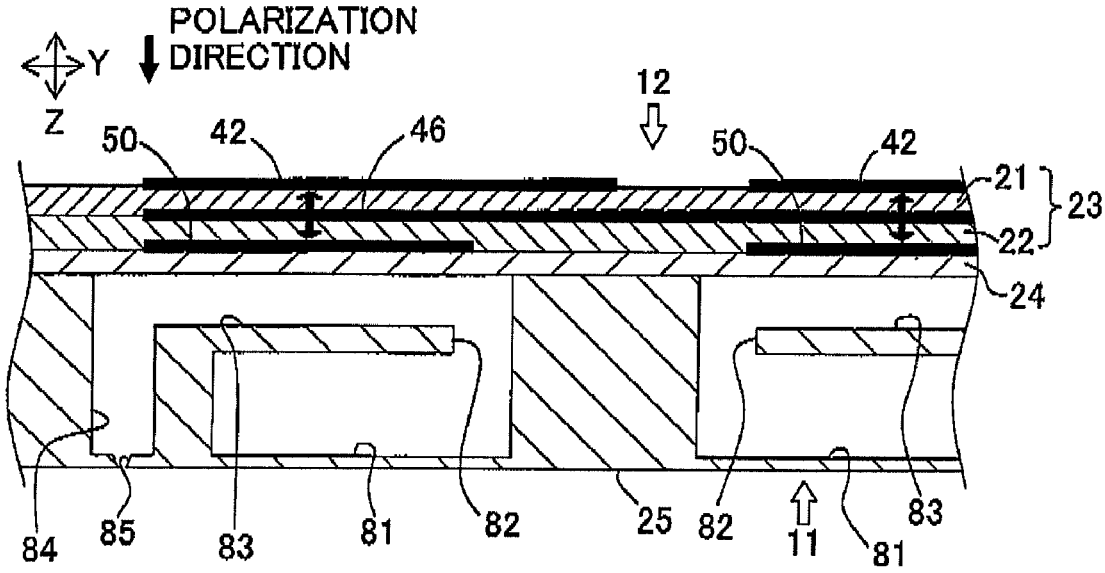
FIG. 3 shows a partial sectional view in a direction perpendicular to the predetermined direction illustrating the arrangement of the piezoelectric actuator and the flow passage unit.
Figure 4:
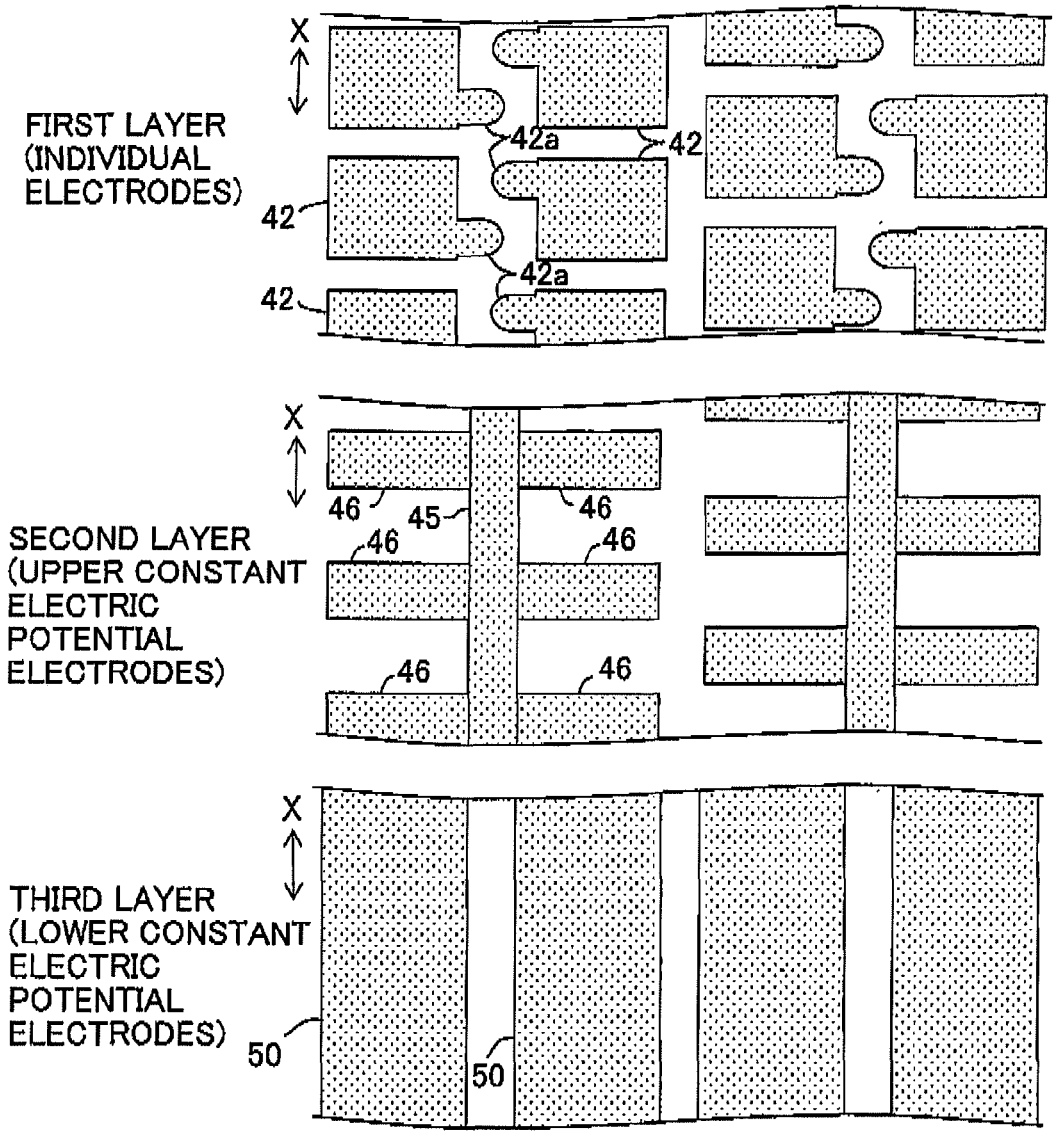
FIG. 4 illustrates an arrangement of electrodes of the piezoelectric actuator.
Figure 5:
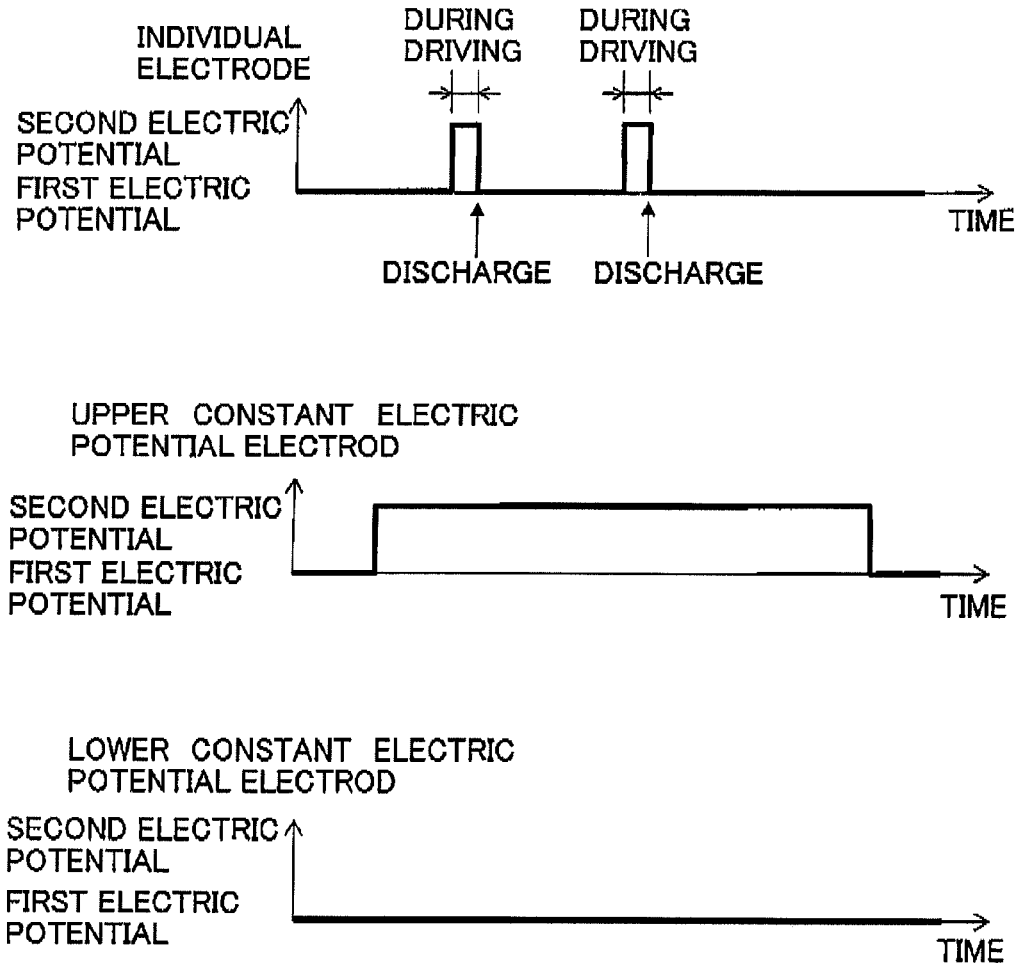
FIG. 5 shows a timing chart to apply the voltage to the electrodes.

In view of the problem as described above, the present inventors have invented a liquid droplet discharge apparatus and a liquid droplet discharge head which make it possible to suppress the crosstalk even when pressure chambers are arranged at a higher density. The structure thereof will be explained with reference to FIGS. 1 to 5. FIG. 1 shows a partial plan view illustrating an arrangement of a piezoelectric actuator and a flow passage unit of the liquid droplet discharge head. FIG. 2 shows a partial sectional view in a predetermined direction illustrating an arrangement of the piezoelectric actuator and the flow passage unit. FIG. 3 shows a partial sectional view in a direction perpendicular to the predetermined direction illustrating the arrangement of the piezoelectric actuator and the flow passage unit. FIG. 4 illustrates an arrangement of electrodes of the piezoelectric actuator. FIG. 5 shows a timing chart to apply the voltage to the electrodes.

A liquid droplet discharge head is provided for a liquid droplet discharge apparatus including, for example, an ink-jet printer. The ink-jet printer includes, for example, a carriage which is movable in a scanning direction, the liquid droplet discharge head which jets liquid droplets toward a recording paper, a transport roller which transports the recording paper, and a control unit which controls the ink-jet printer. In such an ink-jet printer, the liquid droplet discharge head is moved in the scanning direction integrally with the carriage to jet the liquid droplets toward the recording paper from nozzles arranged on the lower surface thereof.

As shown in FIGS. 1 to 4, the flow passage unit 11, the piezoelectric actuator 12, and a flexible wiring board 13 (signal lines) for supplying the driving signals are stacked in this order from the bottom in the liquid droplet discharge head 2.

The flow passage unit 11 is a stack of a plurality of plate members, which is formed with manifolds 81 as common storage chambers for temporarily storing the liquids, and channels for supplying the liquids to respective discharge holes 85 as nozzles from the manifolds 81. The respective channels are constructed by respective spaces including, for example, pressure chambers 83, communication holes 82 for communicating the manifolds 81 and the pressure chambers 83, and communication holes 84 for communicating the discharge holes 85 and the pressure chambers 83. The discharge holes 85 are provided corresponding to the respective pressure chambers 83. The discharge holes 85 are open on the lower surface of the flow passage unit 11 while being regularly aligned in one certain direction (this direction is hereinafter referred to as "X direction" (first direction), and a direction perpendicular to the X direction is referred to as "Y direction" (second direction)). The X direction is substantially perpendicular to the direction of reciprocating movement of the liquid droplet discharge head 2.

The piezoelectric actuator 12 is formed by stacking a piezoelectric layer 23 on a bottom layer 24 to serve as a substrate. In this arrangement, the piezoelectric layer 23 is composed of two layers. The layers composed of two layers of piezoelectric materials, i.e., the top layer 21 as the upper piezoelectric layer and the intermediate layer 22 as the lower piezoelectric layer stacked under the top layer 21 are stacked at the upper and lower positions. The stacking direction of the piezoelectric layers for constructing the piezoelectric actuator 12 is hereinafter referred to as "stacking direction Z". The portion of the piezoelectric layer 23, which is disposed between the opposing electrodes, is electrically the capacitance component.

Individual electrodes 42 are formed on the upper side of the top layer 21 corresponding to the respective pressure chambers 83. Upper constant electric potential electrodes 46 are formed corresponding to the respective individual electrodes 42 (pressure chambers 83) between the top layer 21 and the intermediate layer 22. Lower constant electric potential electrodes 50 are formed between the intermediate layer 22 and the bottom layer 24.

The plurality of individual electrodes 42 are provided and aligned at substantially constant pitches in the X direction on the top layer 21, and they are arranged while being deviated in a zigzag form in the Y direction. Parts of the individual electrodes 42 project in the Y direction, and the projections function as connecting sections 42*a* to be connected connecting terminals of a flexible wiring board 13 as described later on.

The plurality of upper constant electric potential electrodes 46 are arranged at substantially constant pitches in the X direction on the intermediate layer 22. A plurality of arrays of the upper constant electric potential electrodes 46 are aligned in the Y direction. One stripe of first-common conducting section 45, which extends in the X direction, is provided for two rows of the upper constant electric potential electrodes 46. Each one row of the upper constant electric potential electrodes 46 disposed on the both sides of the first-common conducting section 45 is connected to the first-common conducting section 45. The upper constant electric potential electrodes 46 and the individual electrodes 42 are overlapped in the stacking direction Z. The first-common conducting section 45 and the connecting sections 42*a* of the individual electrodes 42 are overlapped in the stacking direction Z as well.

The lower constant electric potential electrodes 50 are formed in a band-shaped form extending in the X direction to serve as the electrodes common to the pressure chambers 83 disposed in the X direction. The lower constant electric potential electrodes 50, the upper constant electric potential electrodes 46, and the individual electrodes 42 are overlapped in the stacking direction.

In the respective electrodes described above, the length of the upper constant electric potential electrode 46 in the X direction is shorter than the length of the individual electrode 42 in the X direction. Therefore, the individual electrode 42, the upper constant electric potential electrode 46, and the lower constant electric potential electrode 50 are overlapped in the stacking direction Z at a substantially central portion of the individual electrode 42 in the X direction. The portion, at which the top layer 21 is interposed between the individual electrode 42 and the upper constant electric potential electrode 46 in the piezoelectric actuator 12 as described above, is hereinafter referred to as "first active section 36". On the other hand, the individual electrode 42 and the lower constant electric potential electrode 50 are overlapped in the stacking direction z at both ends of the individual electrode 42 in the X direction, and the upper constant electric potential electrode 46 is absent between the electrodes. The portions, at which the top layer 21 and the intermediate layer 22 are interposed between the individual electrode 42 and the lower constant electric potential electrode 50 in the piezoelectric actuator 12 as described above, are hereinafter referred to as "second active sections 37".

The driver IC, which supplies the driving signal via the flexible wiring board 13, is electrically connected to the respective individual electrodes 42. The flexible wiring board 13 includes individual electrode connecting sections which are provided with connecting terminals of signal lines for inputting the driving signal to the individual electrodes 42, and constant electric potential electrode connecting sections which are provided with connecting terminals with respect to the upper constant electric potential electrodes 46 and the lower constant electric potential electrodes 50 of the piezoelectric actuator 12. The flexible wiring board 13 functions as the driving voltage-supplying mechanism for the piezoelectric actuator 12.

As shown in FIG. 5, in order to change the volume of the pressure chamber 83, the first electric potential (ground electric potential) is applied to the individual electrode 42 during the waiting via the flexible wiring board 13, and the second electric potential (for example, 20 V), which is different from the above, is selectively applied to the individual electrode 42 during the driving. In this arrangement, the ground electric potential is applied to the individual electrode 42 during the waiting, and the positive electric potential is applied to the individual electrode 42 during the driving. However, the positive electric potential may be applied during the waiting, and the ground electric potential may be applied during the driving. The first electric potential is always applied to the lower constant electric potential electrode 50, and the second electric potential is always applied to the upper constant electric potential electrode 46.

As shown in FIGS. 2 and 3, the first active section 36 is activated by being polarized in the same direction (polarization direction) as the direction of the voltage applied during the waiting. On the other hand, the second active sections 37, 37 are activated by being polarized in the same direction (polarization direction) as the direction of the voltage applied during the driving.

In the liquid droplet discharge head 2 constructed as described above, when a certain electric potential difference is generated between the electrodes, then the voltage is applied to the piezoelectric layer 23 interposed between the electrodes, and the electric field is generated in the thickness direction. In this situation, when the polarization direction of the piezoelectric layer 23 is the same as the direction of the electric field, the inverse piezoelectric effect is caused. The piezoelectric layer 23 is elongated in the thickness direction which is the polarization direction, and the piezoelectric layer 23 is shrunk in the horizontal direction. Therefore, the piezoelectric layer 23, which is disposed at the second active sections 37 applied with no effective voltage to cause the inverse piezoelectric effect, is not deformed during the waiting. The piezoelectric layer 23, which is disposed at the first active section 36 applied with the effective voltage, is elongated in the stacking direction Z directed toward the pressure chamber 83, and the piezoelectric layer 23 is shrunk in the X direction. In this situation, the intermediate layer 22 is joined to the bottom layer 24. Therefore, the difference arises in the strain in the X direction between the top layer 21 and the intermediate layer 22. Accordingly, the piezoelectric layer 23 and the bottom layer 24 are deformed to project in the stacking direction Z directed toward the pressure chamber 83, and the volume of the pressure chamber 83 is decreased.

On the other hand, the inverse piezoelectric effect is caused during the driving. Therefore, the piezoelectric layer 23 of the first active section 36, to which the effective voltage is not applied, intends to restore from the deformation. The second active sections 37, to which the effective voltage is applied, intend to elongate in the stacking direction Z directed toward the pressure chamber 83 and shrink in the X direction. Therefore, the piezoelectric layer 23, which is disposed at the second active sections 37 is deformed so that the piezoelectric layer 23 is warped in the direction to make separation from the pressure chamber 83. The volume of the pressure chamber 83 is increased in accordance with the deformation of the piezoelectric layer 23 corresponding to the first active section 36 and the second active sections 37. The liquid is sucked from the manifold 81 to the pressure chamber 83.

When the same electric potential (ground electric potential) is applied to the individual electrode 42 and the lower constant electric potential electrode 50 again as starting from the state of the driving, a state is given in the same manner as in the waiting state such that the voltage, which is effective to cause the inverse piezoelectric effect, is applied to the first active section 36, and the effective voltage is not applied to the second active sections 37. The volume of the pressure chamber 83 is decreased at once. Accordingly, the liquid is discharged from the discharge hole 85.

As described above, in the liquid droplet discharge head 2 constructed as described above, the piezoelectric layer 23 of the first active section 36 is deformed by switching the application and the non-application of the voltage to the first active section 36. However, the application and the non-application of the voltage are switched with respect to the second active sections 37 so that the deformation of the piezoelectric layer 23 corresponding to the first active section 36 is suppressed from being transmitted to the adjoining pressure chambers 83 by deforming the piezoelectric layer 23 corresponding to the second active sections 37. Therefore, an effect to suppress the crosstalk is obtained.

Figure 6:
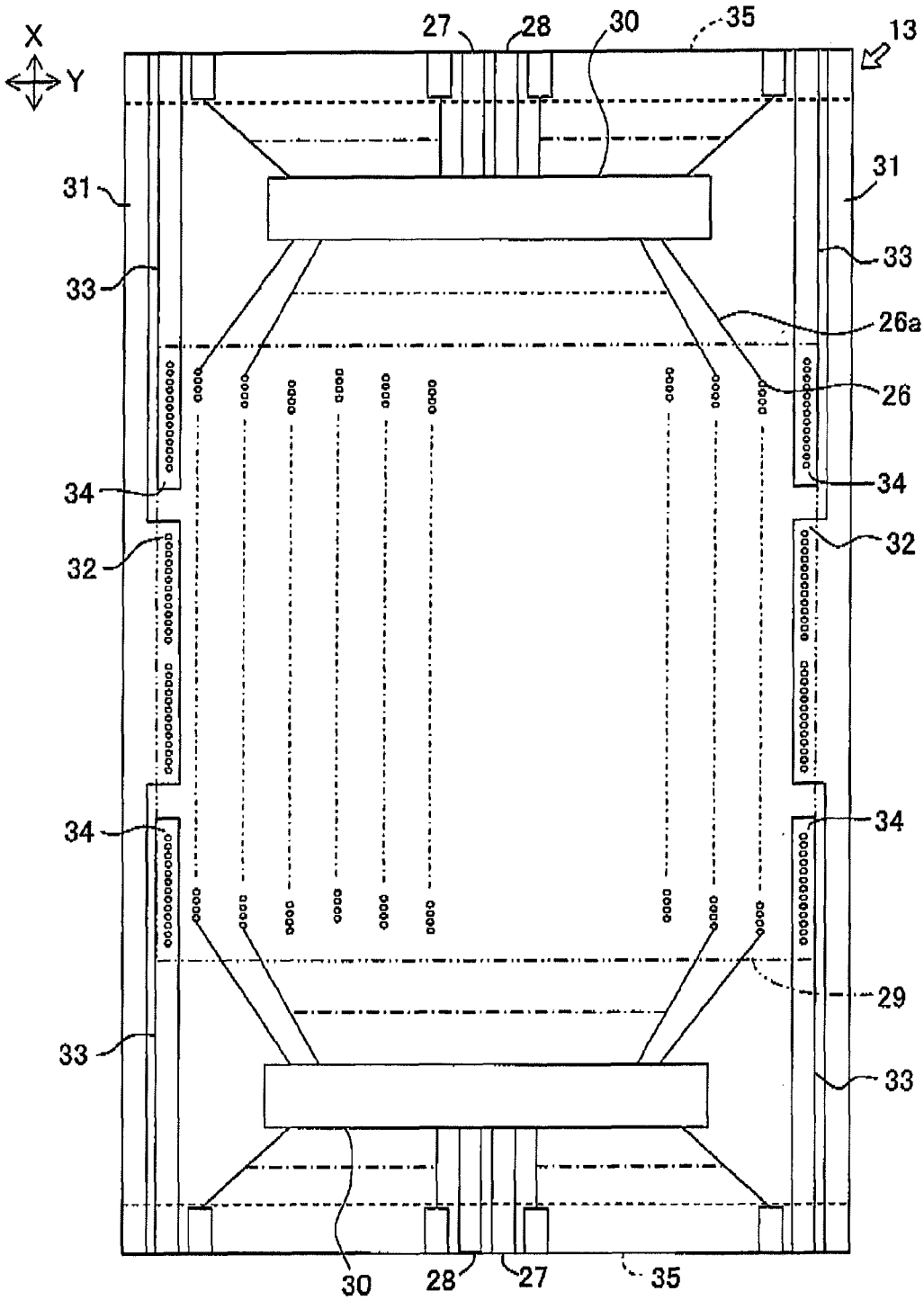
FIG. 6 shows a plan view illustrating a flexible wiring board of the liquid droplet discharge head.

Next, an explanation will be made about the structure of the flexible wiring board 13 provided for the liquid droplet discharge head 2. FIG. 6 shows a plan view illustrating the flexible wiring board of the liquid droplet discharge head.

As shown in FIG. 6, the flexible wiring board 13 is formed to have a substantially rectangular shape which is somewhat long in the X direction. The flexible wiring board 13 has, for example, wirings and connecting sections which are to be connected to the respective electrodes of the piezoelectric actuator 12 and which are formed of, for example, photoresist on the lower surface (joining surface with respect to the piezoelectric actuator 12) of a band-shaped substrate which has an electric insulating property and which is composed of a flexible synthetic resin material. The surface is covered with a cover layer having an electric insulating property. FIG. 6 depicts a state of transmitting through the substrate and the cover layer in order to understand the structure of the flexible wiring board 13 more comprehensively.

The piezoelectric actuator 12 is joined to a substantially central portion (portion 29 surrounded by alternate long and two short dashes lines as shown in FIG. 6) in the X direction of the lower surface of the flexible wiring board 13. A large number of connecting terminals 26, which are to be joined to the connecting sections 42*a* of the individual electrodes 42, are provided at a substantially central portion of the flexible wiring board 13 in the X direction, while being overlapped with the portion to which the piezoelectric actuator 12 is joined. The connecting terminals 26 are connected to output side of driver IC 30 described later on by wirings 26*a*. Input electrode sections 35 are provided at both end edges in the X direction on the lower surface of the flexible wiring board 13 as well. Further, the driver ICs 30, which output the driving voltage to the piezoelectric actuator 12, are provided between the group of the connecting terminals 26 and the input electrode sections 35. The input electrode sections 35 are provided with, for example, input electrodes connected by wirings to the driver ICs 30, driving ground electrodes 27, and driving electrodes 28.

Two first connecting lines 31, which have both ends connected to the input electrode sections 35 and which extend in the X direction, are provided at both end edges of the flexible wiring board 13 in the Y direction. A substantially central portion of the first connecting line 31 in the x direction projects inwardly, and a first-connecting land 32 is provided at the protrusion. Second-connecting lands 34, which are not electrically connected to the first-connecting land 32, are provided on the both sides of the first-connecting land 32 in the X direction. The second-connecting land 34 and the nearest input electrode section 35 are connected to one another by a second connecting line 33 which extends in the X direction. The driving electrode 28 and the second connecting line 33 are connected to one another, and the driving ground electrode 27 and the first connecting line 31 are connected to one another by an unillustrated low impedance wiring board in the vicinity of the input electrode section 35.

The constant electric potential electrode connecting section, which is composed of the first-connecting land 32 positioned at the substantially central portion in the X direction and the second-connecting lands 34 positioned on the both sides of the first-connecting land 32 in the X direction, is formed at each of the ends of the flexible wiring board 13 in the Y direction. The lower constant electric potential electrodes 50 and the upper constant electric potential electrodes 46 of the piezoelectric actuator 12 are electrically connected to the constant electric potential electrode connecting section.

Figure 7:
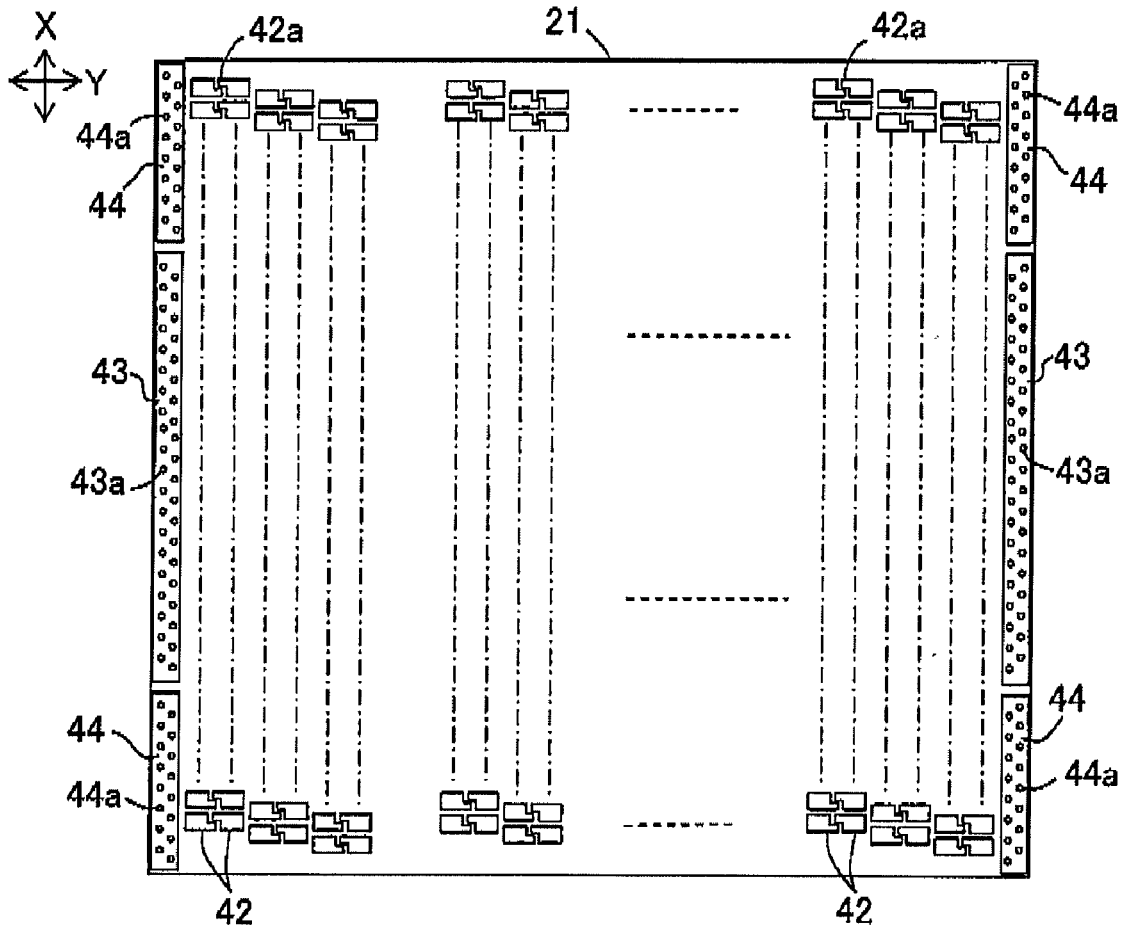
FIG. 7 shows a plan view illustrating individual electrodes and a top layer of the piezoelectric actuator according to a first embodiment.
Figure 8:
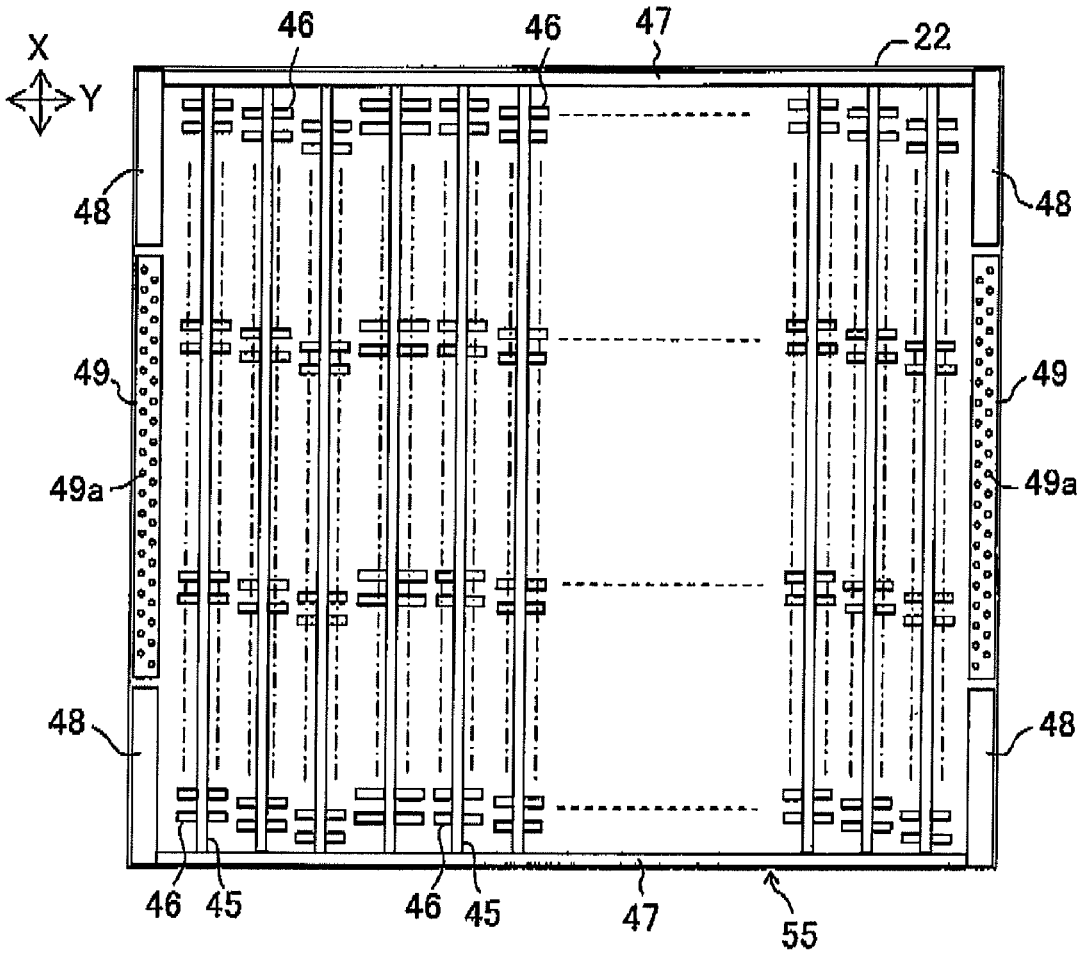
FIG. 8 shows a plan view illustrating upper constant electric potential electrodes and an intermediate layer of the piezoelectric actuator according to the first embodiment.
Figure 9:
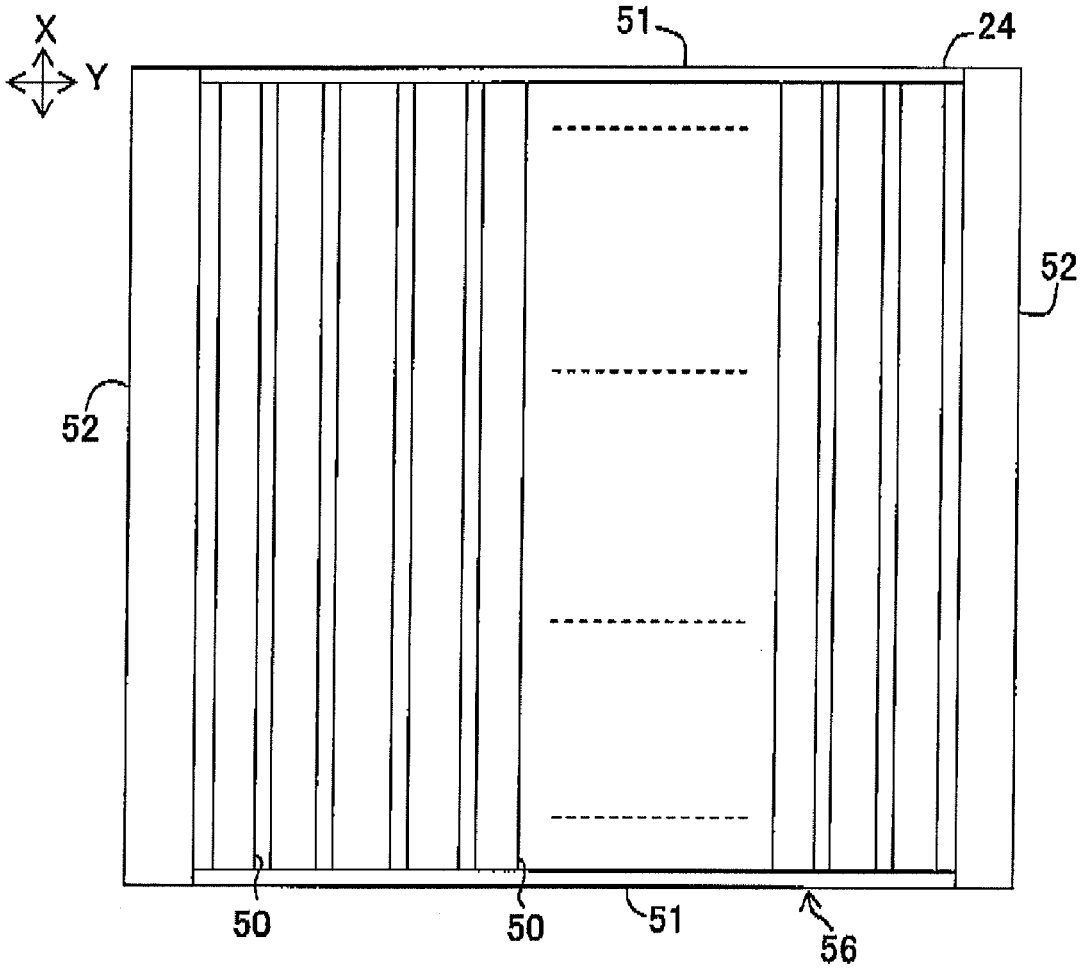
FIG. 9 shows a plan view illustrating lower constant electric potential electrodes and a bottom layer of the piezoelectric actuator according to the first embodiment.

Next, an explanation will be made with reference to FIGS. 7 to 9 about the wiring structure and the shapes of the respective electrodes, i.e., the individual electrodes 42, the lower constant electric potential electrodes 50, and the upper constant electric potential electrodes 46 provided for the piezoelectric actuator 12 included in the liquid droplet discharge head 2. FIG. 7 shows a plan view illustrating the individual electrodes and the top layer of the piezoelectric actuator according to the first embodiment. FIG. 8 shows a plan view illustrating the upper constant electric potential electrodes and the intermediate layer of the piezoelectric actuator according to the first embodiment. FIG. 9 shows a plan view illustrating the lower constant electric potential electrodes and the bottom layer of the piezoelectric actuator according to the first embodiment.

As shown in FIG. 7, the substantially rectangular individual electrodes 42 which correspond to the respective pressure chambers 83 (see FIGS. 2 and 3), second surface electrodes 44 which are arranged at four corners of the top layer 21, and two first surface electrodes 43 which are arranged between the second surface electrodes 44 are provided on the outer surface of the top layer 21.

The individual electrodes 42 are aligned regularly in the X direction to form the rows. The rows of the individual electrodes are aligned in the Y direction. The respective individual electrodes 42 are formed with the connecting sections 42*a* which project toward each of the spaces disposed between the rows, the space being disposed for every two rows. The connecting terminals 26 of the flexible wiring board 13, which are provided on the outer surface of the top layer 21, are joined to the connecting sections 42*a*.

The first surface electrodes 43 are provided at the both ends of the top layer 21 in the Y direction. The first surface electrodes 43 are overlapped in the stacking direction Z with respect to the first-connecting lands 32, 32 of the flexible wiring board 13. In both end portions of the top layer 21, the second surface electrodes 44 are provided at the both end sides of the first surface electrodes 43 in the X direction. The second surface electrodes 44 are overlapped in the stacking direction Z with respect to the second-connecting lands 34. In other words, the first surface electrodes 43 are provided at the substantially central portions in the X direction at the both ends of the top layer 21 in the Y direction. Similarly, the second surface electrodes 44 are provided at the both ends in the X direction.

Any one of the first surface electrode 43 and the second surface electrode 44 is not in electric connection with respect to the individual electrode 42. Through-holes 43*a* which penetrate through the first surface electrodes 43 and the top layer 21 and through-holes 44*a* which penetrate through the second surface electrodes 44 and the top layer 21 are formed in order to electrically connect the first-connecting lands 32 or the second-connecting lands 34 and the electrode sections of the lower layer.

As shown in FIG. 8, a first electrode assembly 55 including the upper constant electric potential electrodes 46, first relay electrodes 48 arranged at four corners of the intermediate layer 22, and two first connecting sections 49 arranged between the first relay electrodes 48 are provided on the upper surface of the intermediate layer 22. The first relay electrodes 48 are conducting sections which are provided at positions overlapped in the stacking direction Z with respect to the second-connecting lands 34 of the flexible wiring board 13. In this way, the second-connecting lands 34 of the flexible wiring board 13, the second surface electrodes 44 of the top layer 21, and the first relay electrodes 48 of the intermediate layer 22 are overlapped with each other in the stacking direction Z, and thus it is possible to reduce the electric potential change in the routes ranging from the second surface electrodes 44 to the first relay electrodes 48. The first connecting sections 49 are provided at the positions overlapped in the stacking direction Z with respect to the first-connecting lands 32 of the flexible wiring board 13. Through-holes 49*a*, which penetrate through the first connecting sections 49 and the intermediate layer 22 and which are communicated with the through-holes 43*a*, are formed in order to electrically connect the first-connecting lands 32 and the electrode sections of the lower layer.

The upper constant electric potential electrode 46 is a substantially rectangular electrode foil. The upper constant electric potential electrodes 46 form the rows by being aligned at substantially constant pitches in the X direction corresponding to the respective individual electrodes 42. A plurality of the rows of the upper constant electric potential electrodes 46 are aligned in the Y direction. One stripe of the first-common conducting section 45, which extends in the X direction, is provided for the two rows of the upper constant electric potential electrodes 46. The upper constant electric potential electrodes 46 of each one row, which are disposed on each of the both sides of the first-common conducting section 45, are connected to the first-common conducting section 45. Both ends of the first-common conducting section 45 in the X direction are connected to the two second-common conducting sections 47 which extend in the Y direction respectively. Both ends of the second-common conducting sections 47 are connected to the four first relay electrodes 48 respectively. In this way, all of the upper constant electric potential electrodes 46, which are provided on the intermediate layer 22, are electrically connected and integrated into one unit by the first-common conducting sections 45 and the second-common conducting sections 47, and thus the first electrode assembly 55 is formed on the intermediate layer 22.

As shown in FIG. 9, a second electrode assembly 56 including the lower constant electric potential electrodes 50, and two second relay electrodes 52 are provided on the upper surface of the bottom layer 24. The second relay electrodes 52 are conducting sections which are provided at positions overlapped in the stacking direction Z with the first-connecting lands 32 of the flexible wiring board 13. The second relay electrodes 52 have band-shaped forms extending in the X direction at the both ends of the bottom layer 24. In this way, the first-connecting lands 32 of the flexible wiring board 13, the first surface electrodes 43 of the top layer 21, and the first connecting sections 49 of the intermediate layer 22 are overlapped with each other in the stacking direction Z, and thus it is possible to reduce the electric potential change in the routes ranging from the first surface electrodes 43 to the second relay electrodes 52.

The lower constant electric potential electrodes 50 are formed as band-shaped common electrodes extending in the X direction to serve as the common electrodes for the pressure chambers 83 aligned in the X direction. In this embodiment, one lower constant electric potential electrode 50 is provided for two rows of the individual electrodes 42. The plurality of lower constant electric potential electrodes 50 are aligned while being separated from each other by spacing distances in the Y direction. The connecting sections 42*a* of the individual electrodes 42 and the first-common conducting section 45 connected to the upper constant electric potential electrodes 46 are overlapped with each other in the stacking direction Z between the lower constant electric potential electrode 50 and the lower constant electric potential electrode 50. In this way, the lower constant electric potential electrodes 50 are formed to have the band-shaped forms, and the adjoining lower constant electric potential electrodes 50 are separated from each other. Further, the first-common conducting sections 45 and the lower constant electric potential electrodes 50 are not overlapped with each other in the stacking direction Z. Accordingly, it is intended to accumulate no electric charge in the piezoelectric actuator 12.

Both ends of the lower constant electric potential electrode 50 in the X direction are connected to two third-common conducting sections 51 respectively. Both ends of the third-common conducting sections 51 are connected to the second relay electrodes 52 respectively. In this way, all of the lower constant electric potential electrodes 50, which are provided on the bottom layer 24, are electrically connected and integrated into one unit by the third-common conducting sections 51, and thus the second electrode assembly 56 is formed on the bottom layer 24.

Next, an explanation will be made about the operation of the piezoelectric actuator 12 constructed as described above, in particular, about the switching of the voltage to be applied to the active sections 36, 37.

The first electric potential and the second electric potential are selectively applied to the connecting section 42*a* of the individual electrode 42 of the piezoelectric actuator 12 from the driver IC 30 of the flexible wiring board 13 via the wiring 26*a* and the connecting terminal 26. The second electric potential is always applied to the upper constant electric potential electrode 46 from the driving electrode 28 of the flexible wiring board 13. Further, the first electric potential is always applied to the lower constant electric potential electrode 50 from the driving ground electrode 27 of the flexible wiring board 13.

When the second electric potential is applied to the individual electrode 42 (portion shown in FIG. 5 at which the electric potential is raised during the driving of the individual electrode 42), the voltage is applied to the internal capacitance of the piezoelectric layer 23 of the second active sections 37. In this situation, the electric potential of the lower constant electric potential electrode 50 is changed, and the voltage is applied to the electric path ranging from the lower constant electric potential electrode 50 to the driving ground electrode 27 of the input electrode section 35 (lower constant electric potential electrode 50, third-common conducting section 51, second relay electrode 52, through-hole 49*a*, first connecting section 49, through-hole 43*a*, first surface electrode 43, first-connecting land 32, first connecting line 31, and driving ground electrode 27 of input electrode section 35). In this way, the electric potential of the third-common conducting section 51 is raised when the second electric potential is applied to the individual electrode 42.

When the second electric potential is applied to the individual electrode 42, the voltage is applied to the internal capacitance of the piezoelectric layer 23 of the first active section 36. In this situation, the electric potential of the upper constant electric potential electrode 46 is changed, and the voltage is applied to the electric path ranging from the upper constant electric potential electrode 46 to the driving electrode 28 (upper constant electric potential electrode 46, first-common conducting section 45, second-common conducting section 47, first relay electrode 48, through-hole 44*a*, second surface electrode 44, second-connecting land 34, second connecting line 33, and driving electrode 28). In this way, the electric potential of the second-common conducting section 47 is raised when the second electric potential is applied to the individual electrode 42.

Subsequently, when the first electric potential is applied to the individual electrode 42 (portion shown in FIG. 5 at which the electric potential is lowered during the driving of the individual electrode 42), the voltage is applied to the internal capacitance of the piezoelectric layer 23 of the first active section 36. In this situation, the electric potential of the upper constant electric potential electrode 46 is changed, and the electric potential of the second-common conducting section 47 is lowered. Further, the voltage is applied to the internal capacitance of the piezoelectric layer 23 of the second active sections 37. In this situation, the electric potential of the lower constant electric potential electrode 50 is changed, and the electric potential of the third-common conducting section 51 is lowered as well.

The liquid droplet discharge head 2 constructed as described above includes the first-connecting land 32 and the second-connecting lands 34 which are provided as the constant electric potential electrode connecting sections on the flexible wiring board 13. Whether the first-connecting land 32 or the second-connecting lands 34 is/are electrically connected to the lower constant electric potential electrodes 50 of the piezoelectric actuator 12 and whether the first-connecting land 32 or the second-connecting lands 34 is/are electrically connected to the upper constant electric potential electrodes 46 are determined based on the impedance (voltage drop) depending on the internal resistances of the second electrode assembly 56 and the first electrode assembly 55. In other words, the combination of the constant electric potential electrodes, to be connected to the first-connecting land 32 or the second-connecting lands 34, and the first-connecting land 32 or the second-connecting lands 34 is determined so that the electrode assembly, which is included in the second electrode assembly 56 which includes the lower constant electric potential electrodes 50 and the first electrode assembly 55 which includes the upper constant electric potential electrodes 46, and which has the larger impedance, is connected to the second-connecting lands 34, and the electrode assembly, which has the smaller impedance, is connected to the first-connecting land 32. The second-connecting lands 34 are disposed nearer to the portions (second-common conducting sections 47, third-common conducting sections 51) of the electrode assemblies at which the current is concentrated. Therefore, as for the second-connecting lands 34, the electric potential can be applied to the electrode assemblies under an advantageous condition in that the voltage drop from the power source to the electrode can be reduced as much as possible. In this way, the difference is more decreased between the electric potential to be applied substantially uniformly to the entire constant electric potential electrodes and the electric potential actually applied to the constant electric potential electrodes, and thus the piezoelectric layer 23 can be operated stably.

This feature is applied to this embodiment, which is specifically explained as follows.

The upper constant electric potential electrodes 46 have the foil-shaped form. Further, the plurality of upper constant electric potential electrodes 46 are connected or combined as if they are branched from one first-common conducting section 45. On the other hand, the lower constant electric potential electrodes 50 have the foil-shaped form, but they have the band-shaped form having the width wider than that of the first-common conducting section 45. The shape and the material quality differ between the first electrode assembly 55 and the second electrode assembly 56. Therefore, when a predetermined current is supplied for the first and second electrode assemblies 55 and 56 respectively, the difference arises in the voltage drop caused by the internal resistance existing in the electrode assemblies. Therefore, if it is assumed that the first-common conducting section 45 and the upper constant electric potential electrode 46 are composed of the foil of the same material and the same thickness, and the predetermined current is applied to the first electrode assembly 55 and the second electrode assembly 56 respectively, then the voltage drop, which is caused in the first electrode assembly 55, is greater than the voltage drop which is caused in the second electrode assembly 56.

In other words, when the voltage fluctuation, which is caused at the end of the second-common conducting section 47 positioned at the corner of the first electrode assembly 55, is compared with the voltage fluctuation which is caused at the end of the third-common conducting section 51 positioned at the corner of the second electrode assembly 56, the voltage fluctuation is greater in the case of the former, because the first electrode assembly 55 has the greater impedance. The voltage fluctuation herein refers to the difference between the electric potential generated in the waiting state and the electric potential generated when all of the provided channels are driven in the liquid droplet discharge head 2.

From the reason as described above, in the liquid droplet discharge head 2 according to this embodiment, the second electrode assembly 56, which includes the lower constant electric potential electrodes 50 of the piezoelectric actuator 12, is electrically connected to the first-connecting lands 32 of the flexible wiring board 13, and the first electrode assembly 55, which includes the upper constant electric potential electrodes 46 of the piezoelectric actuator 12, is electrically connected to the second-connecting lands 34 of the flexible wiring board 13.

Figure 10:
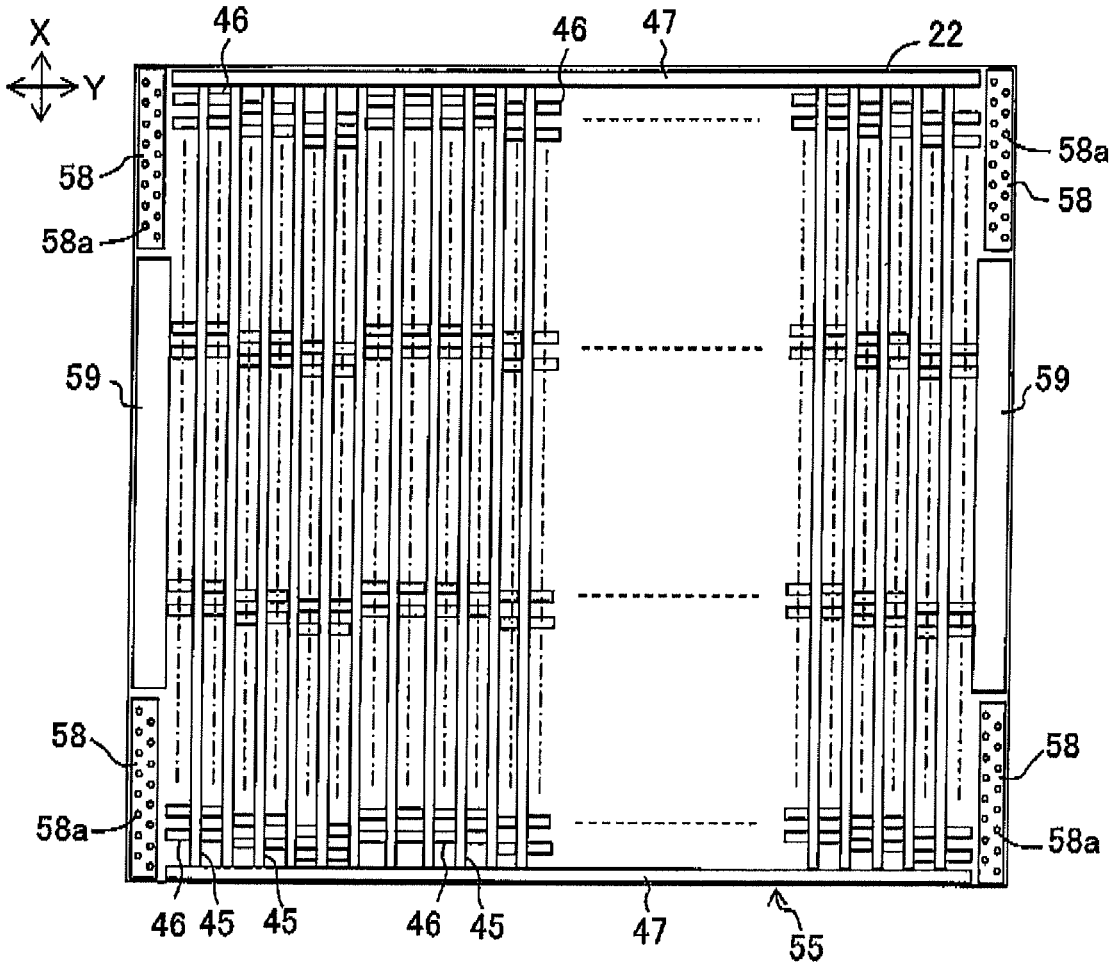
FIG. 10 shows a plan view illustrating upper constant electric potential electrodes and an intermediate layer of a piezoelectric actuator according to a second embodiment.
Figure 11:
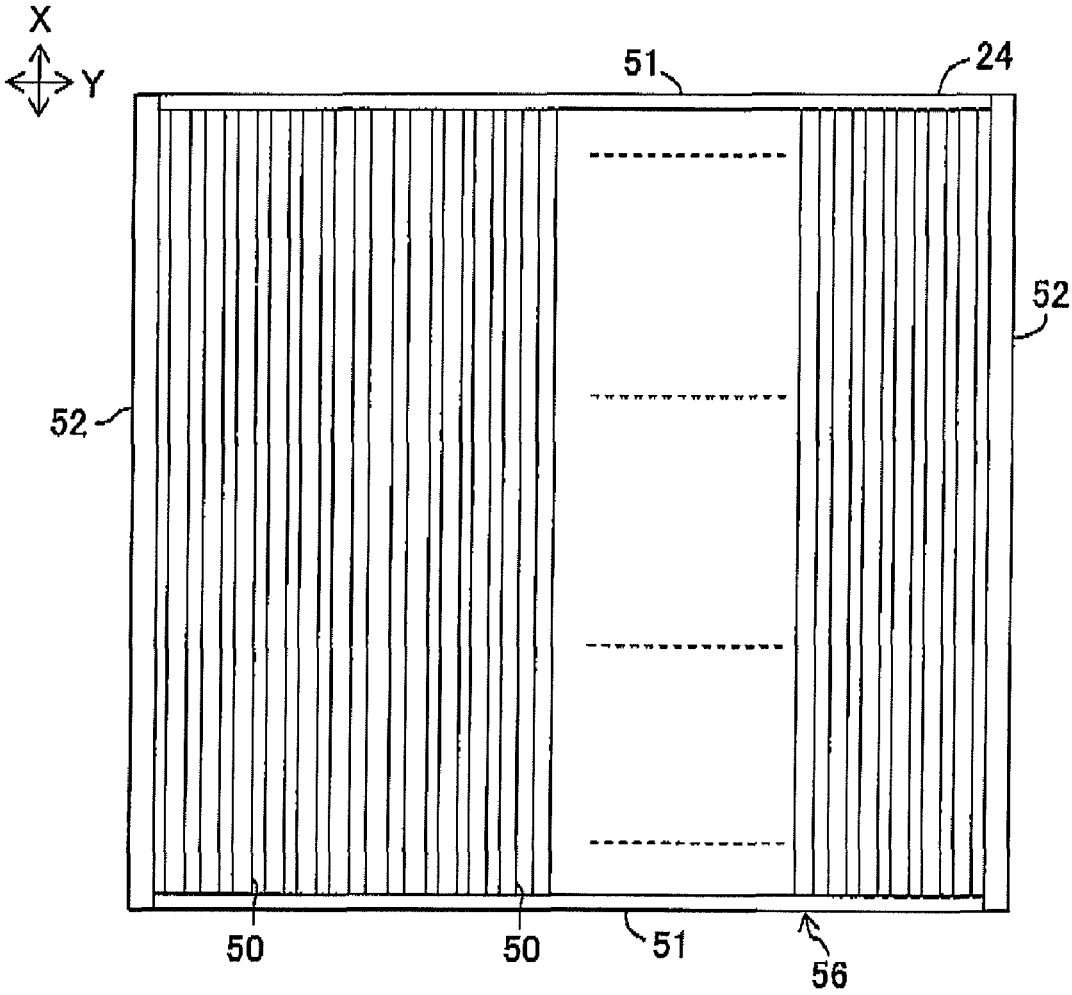
FIG. 11 shows a plan view illustrating lower constant electric potential electrodes and a bottom layer of the piezoelectric actuator according to the second embodiment.
Figure 12:
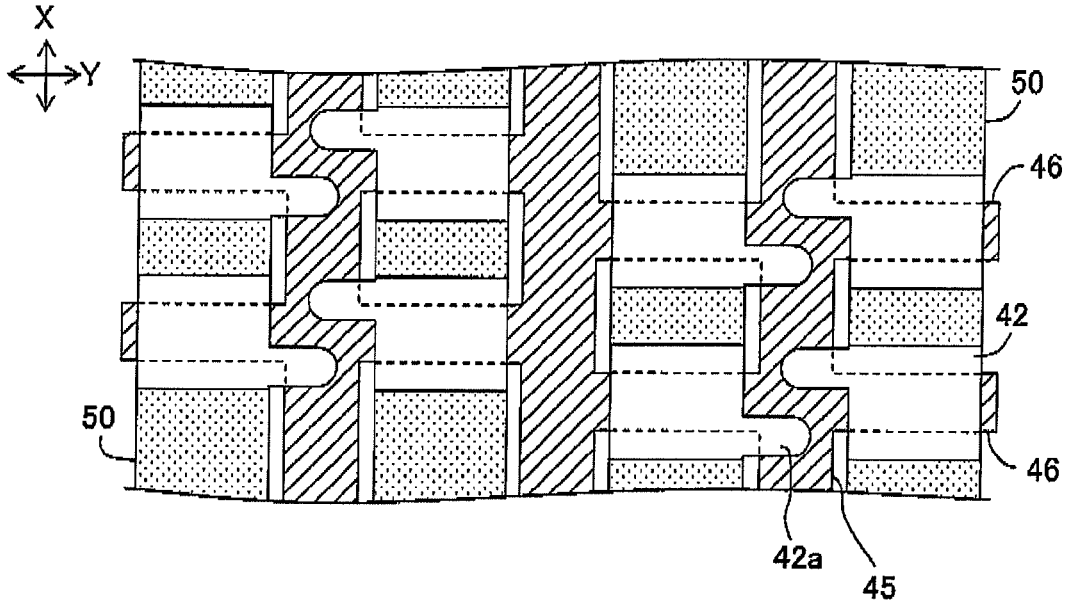
FIG. 12 illustrates an arrangement of electrodes of the piezoelectric actuator according to the second embodiment.

An explanation will be made below with reference to FIGS. 10 to 12 about a liquid droplet discharge head 2 according to a second embodiment of the present invention. FIG. 10 shows a plan view illustrating upper constant electric potential electrodes and an intermediate layer of a piezoelectric actuator according to the second embodiment. FIG. 11 shows a plan view illustrating lower constant electric potential electrodes and a bottom layer of the piezoelectric actuator according to the second embodiment. FIG. 12 illustrates an arrangement of electrodes of the piezoelectric actuator according to the second embodiment. The liquid droplet discharge head 2 according to the second embodiment is constructed in the same manner as the liquid droplet discharge head 2 described in the first embodiment except for the shapes of the constant electric potential electrodes provided for the piezoelectric actuator 12. Therefore, the electrode shape and the wiring structure of the piezoelectric actuator 12 will be explained below, and any other duplicate explanation will be appropriately omitted.

An explanation will be made below about the wiring structure and the shape of each of the electrodes of the individual electrodes 42, the lower constant electric potential electrodes 50 (GND electrodes), and the upper constant electric potential electrodes 46 (VDD electrodes) provided for the piezoelectric actuator 12 included in the liquid droplet discharge head 2. Among them, the individual electrodes 42 are constructed in the same manner as those described in the first embodiment, any explanation of which will be omitted.

As shown in FIGS. 10 and 11, a first electrode assembly 55 which includes the upper constant electric potential electrodes 46, first connecting sections 58 which are arranged at four corners of the intermediate layer 22, and two first relay electrodes 59 which are arranged between the first connecting sections 58 are provided on the upper surface of the intermediate layer 22. The first relay electrode 59 is a connecting section which is provided at the position overlapped in the stacking direction Z with respect to the first-connecting land 32 of the flexible wiring board 13. In this way, the first-connecting lands 32 of the flexible wiring board 13, the first surface electrodes 43 of the top layer 21, and the first relay electrodes 59 of the intermediate layer 22 are overlapped with each other in the stacking direction Z, and thus it is possible to reduce the change of the electric potential in the routes ranging from the second surface electrodes 44 to the first relay electrodes 59. The first connecting sections 58 are provided at the positions overlapped in the stacking direction Z with respect to the second-connecting lands 34 of the flexible wiring board 13. Through-holes 58*a*, which penetrate through the first connecting sections 58 and the intermediate layer 22 and which are communicated with the through-holes 44*a*, are formed in order to electrically connect the second-connecting lands 34 and the electrode sections of the lower layer.

The upper constant electric potential electrodes 46 are substantially rectangular electrode foils, and they form arrays by being aligned at substantially constant pitches in the X direction corresponding to the respective individual electrodes 42. The plurality of arrays of the upper constant electric potential electrodes 46 are aligned in the Y direction. First-common conducting sections 45, which extend in the X direction, are provided between the adjoining arrays of the upper constant electric potential electrodes 46. The first-common conducting sections 45 and the upper constant electric potential electrodes 46 are connected to one another. The upper constant electric potential electrodes 46 and the first relay electrodes 59 are connected to one another in relation to the arrays of the upper constant electric potential electrodes 46 adjacent to the first relay electrodes 59. Further, the both ends of the first-common conducting section 45 in the X direction are connected to the two second-common conducting sections 47 which extend in the Y direction. In this way, all of the upper constant electric potential electrodes 46, which are provided on the intermediate layer 22, are electrically connected and integrated into one unit by the first-common conducting sections 45 and the second-common conducting sections 47. Thus, the mesh-shaped first electrode assembly 55 are formed on the intermediate layer 22.

As shown in FIGS. 11 and 12, a second electrode assembly 56 which includes the lower constant electric potential electrodes 50, and two second relay electrodes 52 are provided on the upper surface of the bottom layer 24. The second relay electrodes 52 are conducting sections which are provided at positions overlapped in the stacking direction Z with respect to the second-connecting lands 34 of the flexible wiring board 13. The second relay electrodes 52 have band-shaped forms extending in the X direction at the both ends of the bottom layer 24 in the Y direction. In this way, the second-connecting lands 34 of the flexible wiring board 13, the second surface electrodes 44 of the top layer 21, and the first connecting sections 58 of the intermediate layer 22 are overlapped with each other in the stacking direction Z. Thus, it is possible to reduce the change of the electric potential in the routes ranging from the second surface electrodes 44 to the second relay electrodes 52.

The lower constant electric potential electrodes 50 are formed as band-shaped common electrodes extending in the X direction so that the lower constant electric potential electrodes 50 are the electrodes common to the pressure chambers 83 aligned in the X direction (see FIGS. 2 and 3). In this embodiment, one lower constant electric potential electrode 50 is provided for one array of the individual electrodes 42. The plurality of lower constant electric potential electrodes 50 are aligned while providing the spacing distances in the Y direction. The connecting sections 42*a* of the individual electrodes 42 and the first-common conducting section 45 connected to the upper constant electric potential electrodes 46 are overlapped with each other in the stacking direction Z between the lower constant electric potential electrode 50 and the lower constant electric potential electrode 50. In this way, the lower constant electric potential electrodes 50 are formed to have the band-shaped forms, and the adjoining lower constant electric potential electrodes 50 are separated from each other. Further, the first-common conducting sections 45 and the lower constant electric potential electrodes 50 are not overlapped with each other in the stacking direction Z. Thus, it is intended to accumulate no electric charge in the piezoelectric actuator 12.

The both ends of the lower constant electric potential electrode 50 in the X direction are connected to the two third-common conducting sections 51 respectively. The both ends of the third-common conducting sections 51 are connected to the second relay electrodes 52 respectively. In this way, all of the lower constant electric potential electrodes 50, which are provided on the bottom layer 24, are electrically connected and integrated into one unit by the third-common conducting sections 51. Thus, the second electrode assembly 56 is formed on the bottom layer 24.

In the liquid droplet discharge head 2 constructed as described above, the first electrode assembly 55, which includes the upper constant electric potential electrodes 46 of the piezoelectric actuator 12, is electrically connected to the first-connecting lands 32 of the flexible wiring board 13. The second electrode assembly 56, which includes the lower constant electric potential electrodes 50 of the piezoelectric actuator 12, is electrically connected to the second-connecting lands 34 of the flexible wiring board 13.

In this embodiment, one lower constant electric potential electrode 50 is provided for one array of the individual electrodes 42. Therefore, the width of the lower constant electric potential electrode 50 is decreased, the number of the lower constant electric potential electrodes 50 is increased, and the impedance of the second electrode assembly 56 is increased as compared with the first embodiment. On the other hand, the first-common conducting sections 45 are provided between the arrays of the upper constant electric potential electrodes 46 respectively, and the first electrode assembly 55 is formed to have the mesh-shaped form. Therefore, the impedance of the first electrode assembly 55 is lowered as compared with the first embodiment. If it is assumed that the first-common conducting section 45 and the upper constant electric potential electrode 46 are composed of the foil of the same material having the same thickness, and the identical current is applied to the first electrode assembly 55 and the second electrode assembly 56, then the voltage drop, which is caused in the second electrode assembly 56, is larger than the voltage drop which is caused in the first electrode assembly 55.

In other words, when the voltage fluctuation, which is caused at the end of the second-common conducting section 47 positioned at the corner of the first electrode assembly 55, is compared with the voltage fluctuation which is caused at the end of the third-common conducting section 51 positioned at the corner of the second electrode assembly 56, the voltage fluctuation is larger in the case of the latter, because the second electrode assembly 56 has the larger impedance.

For the reason as described above, in this embodiment, the first electrode assembly 55, which includes the upper constant electric potential electrodes 46 of the piezoelectric actuator 12, is electrically connected to the first-connecting lands 32 of the flexible wiring board 13, and the second electrode assembly 56, which includes the lower constant electric potential electrodes 50 of the piezoelectric actuator 12, is electrically connected to the second-connecting lands 34 of the flexible wiring board 13.

In the embodiments explained above, two driver ICs 30 are provided on the flexible wiring board 13 at both sides in the X direction respectively. However, when the number of the channels is small, only one driver IC may be provided at one side in the X direction. In this case, the second-connecting lands and the second connecting lines 33 may not be provided at both sides in the X direction with respect to the first-connecting land 32 respectively. The second-connecting lands and the second connecting lines may be provided at a side at which the driver IC is provided with respect to the first-connecting land 32.

The embodiments explained above are the illustrative examples in which the present invention is applied to the ink-jet printer. However, the applicable form of the present invention is not limited thereto. The present invention is also applicable to any liquid droplet discharge apparatus to be used in various fields including, for example, the medical treatment and the analysis without being limited to the ink-jet printer, provided that it is necessary to highly density the arrangement of pressure chambers and suppress the crosstalk in the apparatus.

What is claimed is:

1. A liquid droplet discharge head, comprising:

a flow passage unit which has a plurality of pressure chambers and discharge holes communicated with the pressure chambers respectively, the pressure chambers forming a plurality of pressure chamber rows each of which extends in a first direction and the pressure chamber rows being arranged in a second direction perpendicular to the first direction;

a piezoelectric actuator which is stacked on the flow passage unit and which includes a first piezoelectric layer; a plurality of individual electrodes formed on one surface of the first piezoelectric layer and arranged to form arrays each extending in the first direction corresponding to the pressure chambers respectively; a first electrode assembly formed on the other surface of the first piezoelectric layer and including upper constant electric potential electrodes which are formed and arranged to form arrays corresponding to the individual electrodes respectively, first-common conducting sections to which the arrays of the upper constant electric potential electrodes are connected respectively and each of which extends in the first direction, and two second-common conducting sections which extend in the second direction and to which each of the first-common conducting sections is connected at both ends thereof; a second piezoelectric layer arranged on a side of the other surface of the first piezoelectric layer to interpose the first electrode assembly between the first piezoelectric layer and the second piezoelectric layer; and a second electrode assembly formed on a surface, of the second piezoelectric layer, not facing the first piezoelectric layer and including lower constant electric potential electrodes which are arranged to form arrays corresponding to the arrays of the individual electrodes to extend in the first direction, and two third-common conducting sections to which both ends of each of the lower constant electric potential electrodes are connected respectively and each of which extends in the second direction; and a wiring board which is stacked on the piezoelectric actuator and which includes individual electrode connecting sections applying an electric potential to the individual electrodes; and a constant electric potential electrode connecting section applying an electric potential to the upper constant electric potential electrodes and the lower constant electric potential electrodes, the constant electric potential electrode connecting section including a first-connecting land extending in the first direction and two second-connecting lands arranged on both sides of the first-connecting land in the first direction, wherein the second-connecting lands are arranged in the first direction nearer, than the first-connecting land, to the second-common conducting sections and the third-common conducting sections respectively;

one of the first electrode assembly and the second electrode assembly of the piezoelectric actuator, which has a greater voltage drop due to internal resistance existing therein when a predetermined current is applied thereto, is electrically connected to the second-connecting lands and the other of the first and second electrode assemblies, which has a smaller voltage drop, is electrically connected to the first-connecting land.

2. The liquid droplet discharge head according to claim 1, further comprising:

first relay electrodes which are connected to both ends of the two second-common conducting sections respectively and which are arranged at four corners of the piezoelectric actuator; and a second relay electrode which is connected, at both ends thereof, to the two third-common conducting sections respectively and which extends in the first direction, wherein the first relay electrodes are electrically connected to the second-connecting lands respectively, and the second relay electrode is electrically connected to the first-connecting land.

3. The liquid droplet discharge head according to claim 2, wherein the first relay electrodes are arranged at positions at which the first relay electrodes are overlapped with the second-connecting lands in a stacking direction respectively when the wiring board is stacked on the piezoelectric actuator.

4. The liquid droplet discharge head according to claim 1, further comprising:

a first relay electrode which is connected to the upper constant electric potential electrodes and which is arranged at a subsequently central portion of the piezoelectric actuator in the first direction; and a second relay electrode which has both ends connected to the two third-common conducting sections respectively and which extends in the first direction, wherein the first relay electrode is electrically connected to the first-connecting land, and the second relay electrode is electrically connected to the second-connecting lands.

5. The liquid droplet discharge head according to claim 4, wherein the second relay electrode is arranged at a position at which the second relay electrode is overlapped with the second-connecting lands in a stacking direction when the wiring board is stacked on the piezoelectric actuator.

6. The liquid droplet discharge head according to claim 1, wherein the constant electric potential electrode connecting section of the wiring board is provided on the wiring board along one end edge portion in the second direction.

7. The liquid droplet discharge head according to claim 1, wherein the constant electric potential electrode connecting section of the wiring board is provided on the wiring board at each of both end edge portions in the second direction.

8. The liquid droplet discharge head according to claim 1, wherein a through-hole, via which the constant electric potential electrode connecting section of the wiring board and the first electrode assembly or the second electrode assembly are electrically connected, is formed at a portion, of the piezoelectric actuator, located at a position overlapped with the constant electric potential electrode connecting section of the wiring board in a stacking direction.

9. The liquid droplet discharge head according to claim 1, wherein the wiring board is further provided with driver ICs which are disposed on the wiring board at both ends in the first direction and which are electrically connected to the individual electrodes to supply driving signals.

10. A liquid droplet discharge apparatus, comprising the liquid droplet discharge head as defined in claim 1.

11. A liquid droplet discharge head, comprising:

a flow passage unit which has a plurality of pressure chambers and discharge holes communicated with the pressure chambers respectively, the pressure chambers forming a plurality of pressure chamber rows each of which extends in a first direction and the pressure chamber rows being arranged in a second direction perpendicular to the first direction;

a piezoelectric actuator which is stacked on the flow passage unit and which includes a first piezoelectric layer; a plurality of individual electrodes formed on one surface of the first piezoelectric layer and arranged to form arrays each extending in the first direction, corresponding to the pressure chambers respectively; a first electrode assembly formed on the other surface of the first piezoelectric layer and including upper constant electric potential electrodes which are formed and arranged to form arrays corresponding to the individual electrodes respectively, first-common conducting sections to which the arrays of the upper constant electric potential electrodes are connected respectively and each of which extends in the first direction, and two second-common conducting sections which extend in the second direction and to which each of the first-common conducting sections is connected at both ends thereof; a second piezoelectric layer arranged on a side of the other surface of the first piezoelectric layer to interpose the first electrode assembly between the first piezoelectric layer and the second piezoelectric layer; and a second electrode assembly formed on a surface, of the second piezoelectric layer, not facing the first piezoelectric layer and including lower constant electric potential electrodes which are formed and arranged to form arrays, corresponding to arrays of the individual electrodes, to extend in the first direction, and two third-common conducting sections to which each of the lower constant electric potential electrodes is connected at both ends thereof and each of which extends in the second direction; and a wiring board which is stacked on the piezoelectric actuator and which includes individual electrode connecting sections applying an electric potential to the individual electrodes; and a constant electric potential electrode connecting section applying an electric potential to the upper constant electric potential electrodes and the lower constant electric potential electrodes; the constant electric potential electrode connecting section including: a first-connecting land which is arranged on the wiring board on one end side in the second direction and which extends in the first direction; and two second-connecting lands which are arranged on both sides of the first-connecting land in the first direction, wherein the second-connecting lands are arranged in the first direction nearer, than the first-connecting land, to the second-common conducting sections and the third-common conducting sections; and one of the second-common conducting sections of the first electrode assembly and the third-common conduction sections of the second electric assembly has a greater electric potential difference generated at one end on the one end side in the second direction, during a time period during which the piezoelectric actuator is driven; and the first electrode assembly is electrically connected to the second-connecting lands and the second electrode assembly is electrically connected to the first-connecting land when the second-common conducting sections has the greater electric potential difference; and the second electrode assembly is electrically connected to the second connecting lands and the first electrode assembly is electrically connected to the first connecting land when the third-common conducting sections has the greater electric potential difference.

12. The liquid droplet discharge head according to claim 11, further comprising:

first relay electrodes which are connected to the both ends of the two second-common conducting sections respectively and which are arranged at four corners of the piezoelectric actuator; and a second relay electrode which is connected, at both ends thereof, to the two third-common conducting sections respectively and which extends in the first direction, wherein the first relay electrodes are electrically connected to the second-connecting lands respectively, and the second relay electrode is electrically connected to the first-connecting land.

13. The liquid droplet discharge head according to claim 12, wherein the first relay electrodes are arranged at positions at which the first relay electrodes are overlapped with the second-connecting lands in a stacking direction respectively when the wiring board is stacked on the piezoelectric actuator.

14. The liquid droplet discharge head according to claim 11, further comprising:

a first relay electrode which is connected to the upper constant electric potential electrodes and which is arranged at a subsequently central portion of the piezoelectric actuator; and a second relay electrode which has both ends connected, at both ends thereof, to the two third-common conducting sections respectively and which extends in the first direction, wherein the first relay electrode is electrically connected to the first-connecting land, and the second relay electrode is electrically connected to the second-connecting lands.

15. The liquid droplet discharge head according to claim 14, wherein the second relay electrode is arranged at a position at which the second relay electrode is overlapped with the second-connecting lands in a stacking direction when the wiring board is stacked on the piezoelectric actuator.

16. The liquid droplet discharge head according to claim 11, wherein the constant electric potential electrode connecting section of the wiring board is provided on the wiring board at each of both end edge portions in the second direction.

17. The liquid droplet discharge head according to claim 11, wherein a through-hole, via which the constant electric potential electrode connecting section of the wiring board and the first electrode assembly or the second electrode assembly are electrically connected, is formed at a portion, of the piezoelectric actuator, located at a position overlapped with the constant electric potential electrode connecting section of the wiring board in a stacking direction.

18. The liquid droplet discharge head according to claim 11, wherein the wiring board is further provided with driver ICs which are disposed on the wiring board at both ends in the first direction and which are electrically connected to the individual electrodes to supply driving signals.

19. A liquid droplet discharge apparatus, comprising the liquid droplet discharge head as defined in claim 11.

* * * * *